United States Patent [19]

Branigan et al.

[11] Patent Number: 4,958,166

[45] Date of Patent: Sep. 18, 1990

[54] AMPLITUDE MONOPULSE SLOTTED ARRAY

[75] Inventors: John T. Branigan, Claremont; Michael W. Wronski, Upland, both of Calif.

[73] Assignee: General Dynamics Corp., Pomona Division, Pomona, Calif.

[21] Appl. No.: 196,696

[22] Filed: Aug. 22, 1988

[51] Int. Cl.[5] ..... H01Q 13/10

[52] U.S. Cl. ..... 343/771; 343/770; 343/768

[58] Field of Search ..... 343/771, 768, 858, 767, 343/850, 770

[56] References Cited

U.S. PATENT DOCUMENTS

| | | | |
|---|---|---|---|
| 2,953,784 | 9/1960 | Kowalsky et al. | 343/770 |
| 2,981,948 | 4/1961 | Kurtz | 343/771 |
| 3,150,375 | 9/1964 | Bevan et al. | 343/771 |
| 3,247,512 | 4/1966 | Diamond | 343/9 |
| 3,248,731 | 4/1966 | Bickmore et al. | 343/100 |
| 3,270,336 | 8/1966 | Birge | 343/5 |
| 3,281,851 | 10/1966 | Goebels, Jr. | 343/768 |
| 3,471,857 | 10/1969 | Schwartz | 343/771 |
| 3,508,275 | 4/1970 | Deveau et al. | 343/771 |
| 3,509,577 | 4/1970 | Kinsey | 343/854 |
| 3,711,858 | 1/1973 | Reeder, Jr. | 343/771 |
| 3,877,031 | 4/1975 | Mailloux et al. | 343/778 |
| 3,978,485 | 8/1976 | Bonnaval | 343/771 |
| 4,196,436 | 4/1980 | Westerman | 343/854 |
| 4,283,729 | 8/1981 | Richardson | 343/854 |
| 4,340,892 | 7/1982 | Brunner et al. | 343/771 |
| 4,348,679 | 9/1982 | Shnitkin et al. | 343/768 |
| 4,450,448 | 5/1984 | Albanese et al. | 343/379 |
| 4,525,716 | 6/1985 | Carlin | 343/381 |
| 4,529,988 | 7/1985 | James et al. | 343/731 |

*Primary Examiner*—Rolf Hille
*Assistant Examiner*—Hoanganh Le
*Attorney, Agent, or Firm*—Neil Martin; Leo R. Carroll

[57] ABSTRACT

An antenna system having first and second arrays of radiating members, first and second sets of corresponding bifurcated members and two pairs of feed members. The radiating members of the first and second arrays each have a near end and a far end and a linear portion therebetween with radiating slots formed therein. The linear portions of the radiating members are interleaved in a planar spaced parallel relationship. Each bifurcated member has a unitary portion and a bifurcated portion with the bifurcated portion having a pair of coupling ends. Each bifurcated member is coupled at its unitary portion to the near end of a different radiating member of its corresponding array and also coupled at its coupling ends to a different feed member of its corresponding pair of feed members. The antenna system further includes a monopulse comparator coupled to the input ends of the first and second pairs of feed members for operation as an amplitude comparison monopulse antenna.

12 Claims, 5 Drawing Sheets

AMPLITUDE MONOPULSE SLOTTED ARRAY

BACKGROUND OF THE INVENTION

I. Technical Field

The present invention relates to monopulse tracking antennas. More specifically, the present invention relates to a novel and improved lowsidelobe monopulse track antenna utilizing slot radiators arranged in a traveling wave configuration to achieve amplitude comparison monopulse radiation patterns.

II. Background Art

Weapon systems utilizing microwave radar systems generally suffer serious performance degradation in the jamming environment encountered in tactical situations. Since the potential for jamming is high in almost all tactical situations, techniques to improve the electronic countermeasures (ECM) capability of these systems are of great importance.

Presently deployed microwave tracking systems are susceptible to electromagnetic jamming signals from standoff jammers (SOJs) due to the relatively high sidelobes of the system track antenna. Since the geometry required to position a jammer in the track antenna main lobe has a low probability of occurrence, the highest probability is that the jammer will intercept the antenna pattern in its sidelobes. Therefore, antenna design techniques incorporated into an operational antenna system which reduces the antenna sidelobes can provide significant improvement in microwave vulnerability to jamming signals. However, these techniques for reducing antenna sidelobe levels must not compromise other performance characteristics of the antenna, for optimum operation of the tracking system. Currently there are two types of monopulse antennas commonly used in current active and semi-active radar systems. These types of monopulse antennas are the parabolic reflectors and slot arrays. Each type of antenna has inherent design limitations which result in sidelobe levels much higher than desired for use in tactical situations.

The reflector-type track antenna is one type of monopulse antenna that is usually comprised of a parabolic dish and a four-port waveguide monopulse feed system. This type of antenna realizes amplitude comparison monopulse radiation patterns. In a parabolic track antenna feed system, however, produces considerable aperture blockage. As a result of the blockage effects, it is typical that a large-scale parabolic track antenna will produce sidelobes that are only 16 to 22 dB below the main beam in either or both the elevation and azimuth planes.

The other type of commonly used monopulse antenna is the slotted array antenna. This antenna type is typically used as a track or seeker antenna for radar systems because of its low profile. The conventional slotted array antenna uses phase comparison monopulse processing in its operation. Planar slotted array antennas typically exhibit lower sum sidelobes, over a limited bandwidth, than reflector-type antennas. However, slotted array antennas produce high vestigial lobes in both the azimuth and elevation difference channels, typically 11 to 15 dB below the main beam. These high sidelobes are a result of the aperture distribution being configured to optimize the sum channel performance in terms of gain and beamwidth.

The slotted array antenna uses phase comparison monopulse processing in which difference patterns are obtained by comparing phase values between corresponding halves of the array. For this reason, the difference-mode amplitude distribution suffers a severe discontinuity at the array center. This amplitude distribution discontinuity is also a factor in the high sidelobe levels common to this type of antenna.

In the standoff jamming environment typical of most combat scenarios, track antenna systems need to have sidelobe levels on the order of −30 dB to achieve adequate performance levels. The typical monopulse antenna, either reflector-type or slotted array-type, suffers substantial degradation in performance in the jamming environment. Furthermore, the typical slotted array antenna is perhaps the more vulnerable of the two types of track antennas. The most detrimental effect on system performance is most evident in a phase-comparison monopulse system when jammer noise is received through one of the difference channels.

It is, therefore, an object of the present invention to provide a novel and improved low-sidelobe slotted array amplitude-comparison monopulse track antenna utilizing traveling wave techniques.

SUMMARY OF THE INVENTION

The present invention is an amplitude-comparison monopulse track antenna system using a slotted array antenna and traveling wave techniques. The track antenna system of the present invention includes first and second arrays of radiating members, a plurality of bifurcated members and two pairs of feed members. The radiating members of the first and second arrays each have a linear portion with radiating slots formed therein. The linear portion of the radiating members in the first and second arrays are interleaved in a common plane in a spaced parallel relationship. Each bifurcated member has a unitary portion and a bifurcated portion with the bifurcated portion having a pair of coupling ends. Certain ones of the bifurcated members are each coupled at a corresponding unitary portion to one end of a different radiating member of the first array. Certain other ones of the bifurcated members are each coupled at a corresponding unitary portion to one end of a different radiating member of the second array. Each feed member of a first pair of feed members is respectively coupled to a different coupling end of each one of the certain ones of the bifurcated members. Each feed member of a second pair of feed members is respectively coupled to a different coupling end of each one of the certain other ones of the bifurcated members. The antenna system further includes a monopulse comparator coupled to the feed members of the first and second pairs of feed members for operation as an amplitude comparison monopulse antenna.

BRIEF DESCRIPTION OF THE DRAWINGS

These and other features, objects, and advantages of the present invention will be more fully apparent from the detailed descriptions set forth below taken in conjunction with the drawings in which like reference characters identify correspondingly throughout and wherein.

DETAILED DESCRIPTION OF THE PREFERRED EMBODIMENTS

The present invention is an advanced low-sidelobe amplitude comparison monopulse track antenna for narrow beam track radars. The track antennna of the present invention exhibits low-sidelobes in both the sum and difference patterns and has a broadband capability. In order to provide low sidelobe monopulse characteristics for both the sum and difference channel outputs, traveling wave techniques are utilized in the development of the antenna. Using the teachings of the present invention, a track antenna is realized that has low-sidelobe monopulse characteristics in both the sum and difference channels in excess of −40 dB. Using the traveling wave techniques, a slotted array antenna is constructed such that amplitude comparison monopulse radiation patterns are obtained. Therefore, the present invention provides for an amplitude comparison monopulse antenna having the advantages of (1) close control of the aperture distribution associated with planar array designs; (2) no compromise in the difference channel sidelobe levels since the amplitude comparison monopulse techniques are employed; (3) no aperture blockage as experienced in reflector-type antennas; and (4) improvements in performance over frequency from comparable standing wave antennas.

Figure 1:
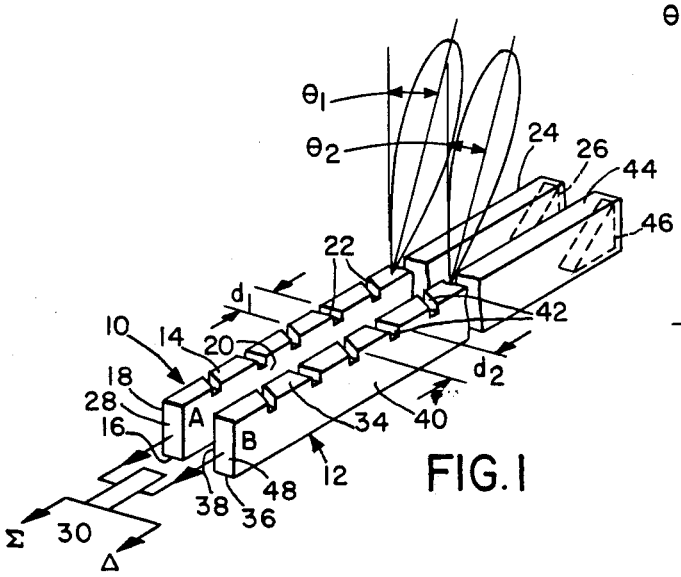
FIG. 1 is a diagrammatic view of a single-plane traveling-wave monopulse antenna.

Turning now to FIG. 1, shown therein is an alternating array of radiating waveguides comprised of waveguides 10 and 12. Waveguides 10 and 12 are hollow, rectangular linear waveguides positioned in a parallel spaced-apart relationship.

Waveguide 10 is constructed with opposed parallel top and bottom walls 14 and 16, that are perpendicularly intersected by parallel sidewalls 18 and 20. Formed along the length of waveguide 10 is a plurality of edge slots 22. Edge slots 22 are cut across, and through, narrow top wall 14 while extending downwardly into a portion of the sidewalls 18 and 20. Slots 22 are spaced apart along the length of waveguide 10 by a distance $d_1$. Slots 22 are cut at specific angles along the length of waveguide 10 to obtain particular conductance values. The angles at which slots 22 are cut are well known in the art. Mounted inside waveguide 10 at end 24 is radio frequency (RF) absorber 26. Absorber 26 is typically a wedge-shaped piece of carbon well known in the art for waveguide termination. The other end of waveguide 10, end 28, is coupled to one symmetry arm of a single-plane comparator or hybrid tee 30.

In FIG. 1, waveguide 12 is constructed similar to waveguide 10 with opposed parallel top and bottom walls 34 and 36, that are perpendicularly intersected by parallel sidewalls 38 and 40. Formed along the length of waveguide 12 is a plurality of edge slots 42. Edge slots 42 are cut across, and through, narrow top wall 34 while extending downwardly into a portion of sidewalls 38 and 40. Slots 42 are spaced apart along the length of waveguide 12 by a distance $d_2$. Slots 42 are similarly cut at specific angles along the length of waveguide 12 to obtain particular conductance values. The angles at which slots 42 are cut are well known in the art. Mounted inside waveguide 12 at end 44 is radio frequency (RF) absorber 46. Absorber 46 is typically a wedge-shaped piece of carbon well known in the art as an appropriate waveguide termination. The other end of waveguide 12, end 48, is coupled to the other symmetry arm of hybrid tee 30.

As electromagnetic energy (energy) is coupled into the waveguides, the waves travel across the aperture of the waveguides. Energy is coupled out of each slot in proportion to conductance of the respective slot, thus, giving the required amplitude distribution for a particular sidelobe level. A variety of tapered distribution schemes, well known in the art, may be used to give low sidelobes and/or shaped beams. Any remaining energy that is not coupled out of the waveguide slot radiators is absorbed in the waveguide termination. It is therefore necessary for the RF absorber in each waveguide to have a very low reflection ratio so that unwanted beams, due to reflections within the waveguide, will not be formed.

The spacing of the radiating slots for a traveling wave slotted array antenna is normally made either greater or less than a half wavelength of the operating frequency of the antenna. This particular slot spacing is necessary since an integral multiple of a half-wavelength spacing causes extremely high standing waves on the waveguide feedline. Traveling wave arrays are therefore characteristically non-resonant antennas. Traveling wave arrays exhibit a large operational bandwidth due to the variation in phase difference between the reflections of various slots. Therefore, the resulting sum of all of the reflected waves is generally very small.

The beam squint or look angle of the beam off the boresight axis of the waveguide is the angle $\theta$. Beam squint $\theta$ is a result of the antenna non-resonance and is determined by the following equation:

$$\sin\theta = \frac{\lambda}{\lambda g} - \frac{\lambda}{2d} \quad (1)$$

where:

$\lambda$ is the wavelength of operating frequency;

$\lambda g$ is the wavelength in the waveguide; and d is the distance between radiating slot elements The guide wavelength $\lambda g$ is given by the following equation:

$$\lambda g = \frac{\lambda}{\sqrt{1 - (\lambda/2a)^2}} \quad (2)$$

where a is the inside cross-sectional width dimension of the conventional rectangular waveguide.

Equation (1) indicates that either or both slot spacing and/or guide wavelength can be altered to control the beam tilt angle. Equation (1) also indicates that the tilt angle will scan with changes in operating frequency. A frequency scannable array is therefore feasible utilizing the teachings of the present invention.

In FIG. 1, the beam-tilt angle of waveguides 10 and 12, as determined by equations (1) and (2), may be set independent from one another. For example, using different spacings of radiating slots ($d_1$ set unequal to $d_2$) with a common guide wavelength, different beam tilt angles are obtained. In FIG. 1, waveguide 10 has a squint angle $\theta_1$, and waveguide 12 has a different tilt angle $\theta_2$.

Figure 2A:
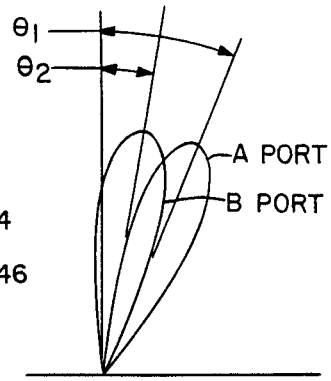
FIG. 2 respectively illustrates in graphs 2A and 2B beam-tilt angle and comparator output for the antenna of FIG. 1.
Figure 2B:
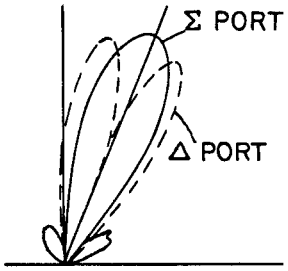

FIG. 2A is a graph illustrating beam-tilt angles for the alternate radiating arrays, waveguides 10 and 12. In FIG. 2A, the beam pattern for the A port (waveguide 10) has a beam-tile angle of $\theta_1$ from the boresight axis of the waveguide (the array normal). The beam pattern for the B port (waveguide 12) has a beam tilt angle of $\theta_2$ from the array normal.

When alternate linear radiating arrays, waveguides 10 and 12, each have a slightly different tilt angle and are fed into a hybrid tee 30, single-plane monopulse information is obtained. It should be noted that a phase adjustment is required in one of the symmetry arms coupling the hybrid tee to a waveguide in order to have equal phase centers. Phase adjustment is necessary since the hybrid tee adds the signals vectorially. This phase adjustment may be accomplished by any of several phase alteration means that is well known in the art. One phase adjustment technique is simply allowing one waveguide to be longer than the other by the required amount of phase shift so that sufficient null depth is obtained at the difference port. The output signals at the hybrid tee sum ($\tau$) and difference ($\Delta$) ports are given respectively by the equations:

$$\Sigma = A\angle\Psi a + B\angle\Psi b \quad (3)$$

$$\Delta = A\angle\Psi a - B\angle\Psi b \quad (4)$$

where:

A is the absolute magnitude of all the energy coupled to waveguide 10 by radiating slots 22;

B is the absolute magnitude of all the energy coupled to waveguide 12 by radiating slots 42;

$\Psi_a$ is the resulting phase of the beam from waveguide 10; and $\Psi_b$ is the resulting phase of the beam in waveguide 12.

The beam positions from the two waveguide outputs will track each other over frequency, therefore, the monopulse beam will not be degraded. However, the varying beam positions will have an effect on the null depth versus frequency characteristics of the antenna.

In implementing a two-dimensional (elevation and azimuth) amplitude-comparison monopulse antenna, the previously discussed traveling wave techniques are employed. Utilizing these techniques, four separate beams are provided, each beam having the same radiating phase center, but radiate in different spatial directions.

Figure 3:
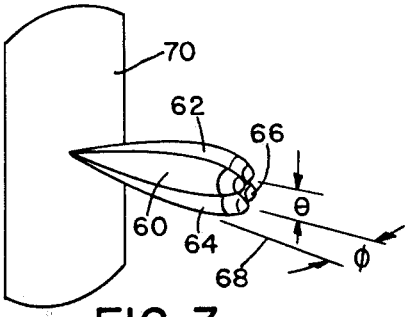
FIG. 3 illustrates a diagrammatic representation of beam positions for a two-dimensional antenna configuration.

FIG. 3 illustrates a two-dimensional amplitude-comparison monopulse antenna with the four separate beams, 60, 62, 64 and 66 being the beam shapes generated by the entire array. Beams 60–66 are all tilted at an angle $\theta$ from line 68 which is normal to plane 70 of the array. Line 68 is typically the boresight axis of the array. In addition, beams 60–66 are tilted by an angle $\phi$ off line 68 perpendicular the direction of the angle $\theta$.

Figure 4:
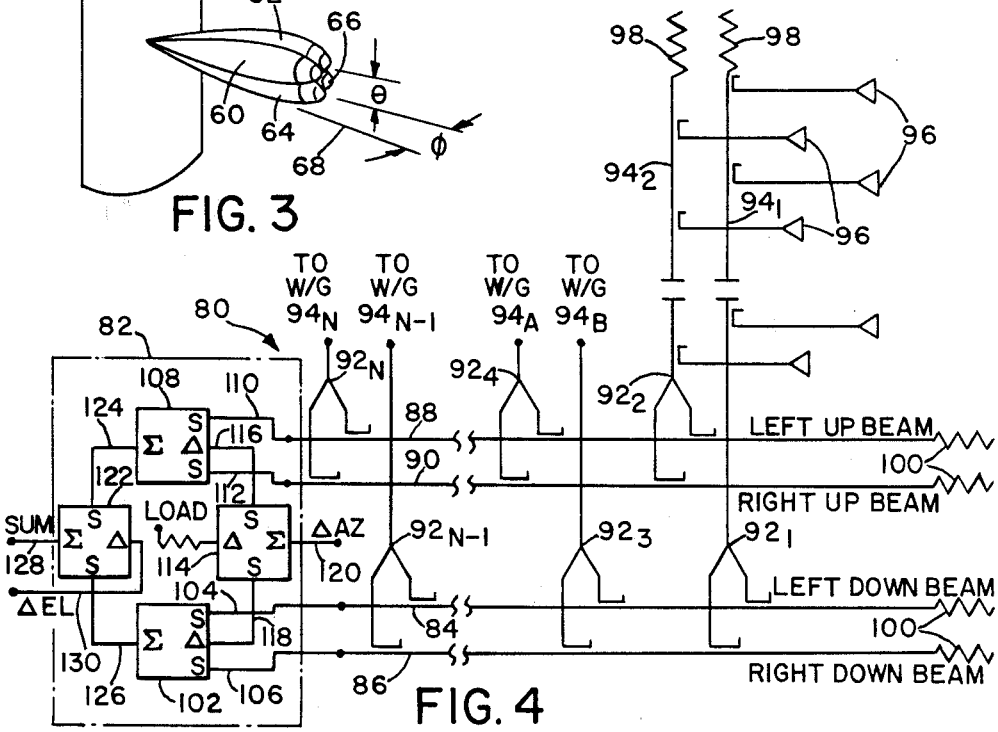
FIG. 4 is a schematical diagram of an amplitude-comparison monopulse antenna assembly utilizing traveling wave techniques.

Referring to FIG. 4, there is shown in schematical form, a diagram of the amplitude-comparison monopulse antenna of the present invention which utilizes traveling wave techniques. Antenna assembly 80 is comprised of a monopulse comparator 82 which is coupled to a first pair of feed waveguide, waveguides, 84 and 86, and a second pair of feed waveguides, waveguides 88 and 90. Channel outputs from monopulse comparator 82 are the sum channel (SUM) output, and the difference channels for elevation (A EL) and azimuth ($\Delta$AZ).

The first and second pairs of feed waveguides, waveguides 84, 86 and 88, 90, are each coupled through a series of waveguide hybrid power dividers 92 that may be implemented by magic-tees or short slot hybrids to an array of radiating waveguides 94, such as the radiating waveguides 10, 12 shown in FIG. 1. A; and plurality of radiating slots 96 is disposed along a lengthwise edge of the linear portion of each waveguide 94. A waveguide termination or RF absorber 98, such as RF absorbers 26 and 46 of FIG. 1, is disposed in an end of each radiating waveguide 94 opposite the end connecting to bifurcated waveguide 92. Similarly, each feed waveguide 84, 86, 88 and 90 has mounted in an end opposite the connection to monopulse comparator 82, a waveguide termination or RF absorber 100.

In the array of radiating waveguides 94, there are a total of N radiating waveguides with each waveguide 94 having a subscript indicating a particular radiating waveguide of the antenna. For example, a first radiating waveguide is identified by the reference numeral $94_1$ while the second radiating waveguide is identified by the reference numeral $94_2$. The last radiating waveguide in the antenna is identified by the reference numeral $94_N$. The radiating waveguides $94_1$–$94_N$ are each positioned in a common plane in a spaced-apart parallel relationship in the antenna assembly with radiating waveguides 94 alternating in connection with a first or second set of feed waveguides. For example, radiating waveguide $94_1$ is coupled by bifurcated waveguide $92_1$ to feed waveguides 84 and 86 of the first pair of feed waveguides. Radiating waveguide $94_2$, mounted adjacent to radiating waveguide $94_1$, is coupled through bifurcated waveguide $92_2$ to feed waveguides 88 and 90 of the second pair of feed waveguides. Similarly, feed waveguide $94_3$ is coupled through bifurcated waveguide $92_3$ to feed waveguides 84 and 86 of the first pair of feed waveguides. A similar arrangement is followed through to the last radiating waveguide $94_N$ with radiating waveguides 94 having an odd reference numeral subscript being coupled to the first pair of feed waveguides, waveguides 84 and 86, so as to form a first array of radiating waveguides. Radiating waveguides 94 with an even reference numeral subscript are coupled to the second pair of feed waveguides, waveguides 88 and 90, so as to form a second array of waveguides. The waveguides of the different arrays are alternated in arrangement in the antenna assembly.

The energy coupled through feed waveguide 88 is generally associated with the antenna LEFT UP beam, identified as beam 60 in FIG. 3. Similarly, the beam associated feed waveguide 90 is the antenna RIGHT UP beam, identified as beam 62 in FIG. 3. The energy coupled through feed waveguide 84 is generally associated with the antenna LEFT DOWN beam, identified as beam 64 in FIG. 3. Finally, the beam associated feed waveguide 86 is the antenna RIGHT DOWN beam which is identified as beam 66 in FIG. 3.

Monopulse comparator 82 is comprised of four hybrid tees 102, 108, 114 and 122, each having a sum and difference arm along with a pair of symmetry arms. In FIG. 4, hybrid tee 102 has a pair of symmetry arms 104 and 106 respectively coupled to feed waveguides 84 and 86. Similarly, hybrid tee 108 has a pair of symmetry arms 110 and 112 respectively coupled to feed waveguides 88 and 90. Hybrid tee 114 has symmetry arm 116 coupled to the difference arm of hybrid tee 108. Hybrid tee 114 also has symmetry arm 118 coupled to the difference arm of hybrid tee 102. The sum arm 120 of hybrid tee 114 provides the azimuth difference channel output (ΔAZ). The difference arm of hybrid tee 114 is coupled to a terminating load. Hybrid tee 122 has symmetry arm 124 coupled to the sum arm of hybrid tee 108. Similarly, hybrid tee 122 has symmetry arm 126 coupled to the sum arm of hybrid tee 102. The sum arm 128 of hybrid tee 122 provides the comparator sum channel output (SUM). The difference arm 130 of hybrid tee 122 provides the elevation difference channel output (ΔEL).

In antenna system 80, two azimuth beams are generated by the coupling of a pair of feed waveguides to a single radiating waveguide. For example, feed waveguides 84 and 86 are coupled by bifurcated waveguide $\mathbf{92}_{(odd)}$ to radiating waveguide $\mathbf{94}_{(odd)}$. This arrangement provides a pair of azimuth beams emanating from each radiating waveguide with the pair of beams having the same phase center.

The coupling of feed waveguides 88 and 90 by bifurcated waveguides $\mathbf{92}_{(even)}$ to other ones of the radiating waveguides $\mathbf{94}_{(even)}$ also provides a pair of beams from each radiating waveguide $\mathbf{94}_{(even)}$. These beams have azimuth angles different from the azimuth angles of the beams produced by radiating waveguides $\mathbf{94}_{(odd)}$ coupled to feed waveguides 84 and 86. The alteration in guide wavelength or the slot element spacing between alternating radiating waveguides provides an offset in elevation between the beams associated with each array of radiating waveguides. It should be noted that phase adjustments will be required at the output of the four feed waveguides and at the output of alternate radiating waveguides so that the relative phases of all the beams will be equal. Phase adjustment at the feed waveguide outputs may be accomplished by adjustment of the electrical length of one of the feed waveguides. This adjustment is accomplished by extending the length of one feed waveguide relative to the other. In addition, phase adjustments at the output ports of the alternate waveguides may be accomplished by similar methods.

Figure 5:
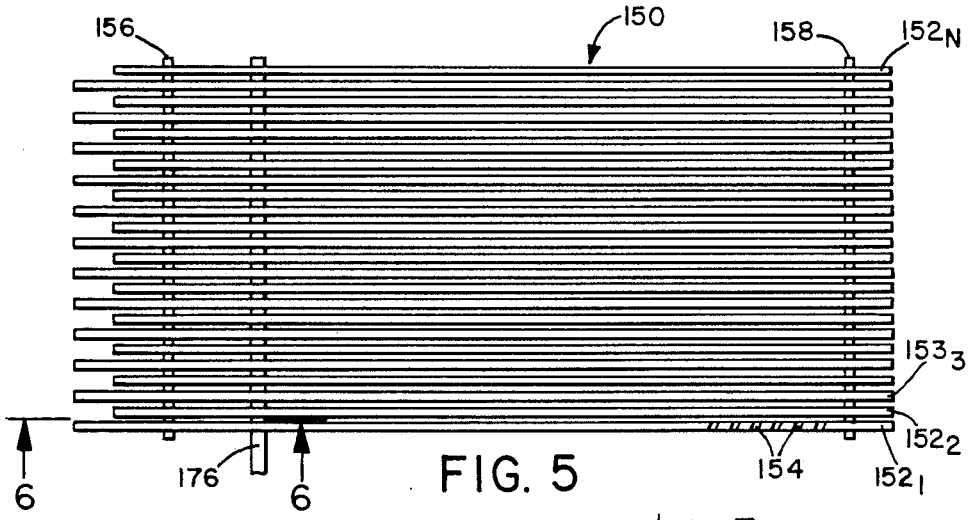
FIG. 5 is a front face view of a typical antenna.

FIG. 5 illustrates a front view of a slotted array antenna 150 of the present invention. In FIG. 5 a plurality of linear rectangular radiating waveguides 152 are positioned with a linear portion of each in a spaced apart parallel arrangement. Edge slots 154 are positioned along the front of the linear portion of each radiating waveguides 152 on the narrow forward facing edge thereof.

Radiating waveguides 152 are held in position by attachment to a pair of support members 156 and 158. Support members 156 and 158 are mounted parallel with respect to one another and perpendicular to the radiating waveguides 152 near opposite side edges of the antenna.

In antenna 150, radiating waveguides 152 having an odd reference numeral subscript define a first array having a particular guide wavelength and slot element spacing. Radiating waveguides 152 having an even reference numeral subscript define a second array which have a different radiating guide wavelength or slot element spacing from the radiating waveguides of the first array.

Figure 6:
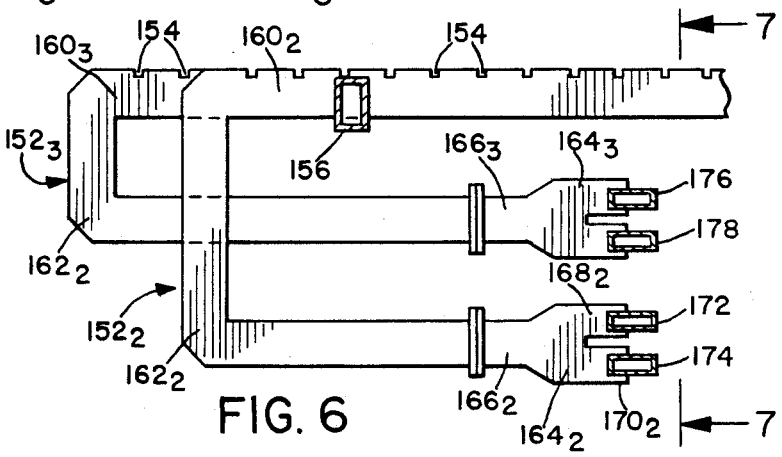
FIG. 6 is an enlarged sectional view taken on line 6—6 of FIG. 5.

FIG. 6 is a sectional view of antenna 150 taken along line 6—6 of FIG. 5 and illustrates radiating waveguides $\mathbf{152}_2$ and $\mathbf{152}_3$. The linear portion of radiating waveguides $\mathbf{152}_2$ and $\mathbf{152}_3$, respectively portions $\mathbf{160}_2$ and $\mathbf{160}_3$, are respectively each connected at one end to an L-shaped portion, respectively coupling portions $\mathbf{162}_2$ and $\mathbf{162}_3$, to give each of the radiating waveguides a J-shaped configuration. The end of each coupling portion 162 opposite the corresponding waveguide linear portion 160 is coupled to an end of a unitary portion 166 of a corresponding bifurcated waveguide 164. For example, coupling portion $\mathbf{162}_2$ of radiating waveguide $\mathbf{152}_2$ is coupled to unitary portion $\mathbf{166}_2$ of bifurcated waveguide $\mathbf{164}_2$. Bifurcated waveguide $\mathbf{164}_2$ is a power divider which has a bifurcated portion defined by a pair of arms $\mathbf{168}_2$ and $\mathbf{170}_2$. Arm $\mathbf{168}_2$ is coupled at an end to feed waveguide 172 while arm $\mathbf{170}_2$ is coupled to feed waveguide 174. Similarly, radiating waveguide $\mathbf{152}_3$ of the other array is coupled by bifurcated waveguide $\mathbf{164}_3$ to feed waveguides 176 and 178. Waveguides 172 and 174 are representative of feed waveguides 88 and 90 of FIG. 4. Similarly, waveguides 176 and 178 are representative of feed waveguides 84 and 86 of FIG. 4.

Figure 7:
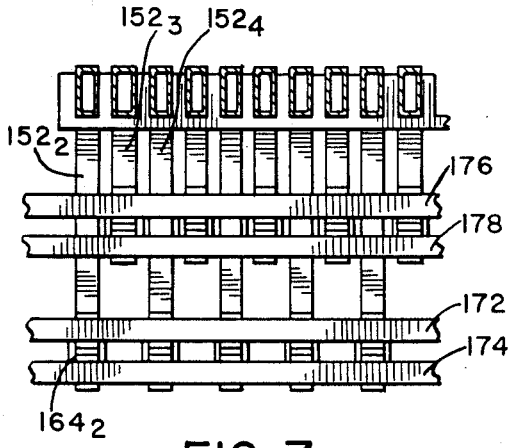
FIG. 7 is a sectional view taken on line 7—7 of FIG. 6.

FIG. 7 illustrates a sectional view of antenna 150 taken along line 7—7 of FIG. 6. FIG. 7 illustrates the interleaving of radiating waveguides 152 of the different arrays and each respective array radiating waveguide coupling to the feed waveguides. As illustrated in FIG. 7, radiating waveguides 152 having an odd reference numeral subscript are coupled to feed waveguides 176 and 178. Similarly, radiating waveguides 152 having an even reference numeral subscript are coupled to feed waveguides 172 and 174. Feed waveguides 172, 174 and 176, 178 extend perpendicular to radiating waveguides 152 and are positioned in-line with one another when viewed from the front of the array such as in FIG. 5. Radiating waveguides 152 having an odd reference numeral subscript have a tighter formation in the J-shaped configuration of respective radiating waveguide coupling and linear portions than the radiating waveguides having an even reference numeral subscript. This type of structural configuration permits an in-line or stacked orientation of the feed waveguides in the linear portions of the radiating waveguides 152. A monopulse comparator (not shown in FIGS. 5, 6 and 7) is coupled to one end of each of the feed waveguides with the other end of each feed waveguide being terminated with an RF absorber.

A full-up array was developed to demonstrate the concept of the present invention. This array had the physical dimensions of 53 wavelengths at center frequency (λo) in width and 28.3 λo in height while consisting of 64 radiating waveguides of half height WR-6 type waveguide that were spaced apart 0.436 λo in the azimuth plane. The antenna was constructed with alternate waveguides of the 64 radiating waveguide array having 89 and 92 slot elements each. The initial respective spacings of the slots were 0.574 λo and 0.571 λo. The alternate radiating waveguides also had a common guide wavelength.

Figure 9:
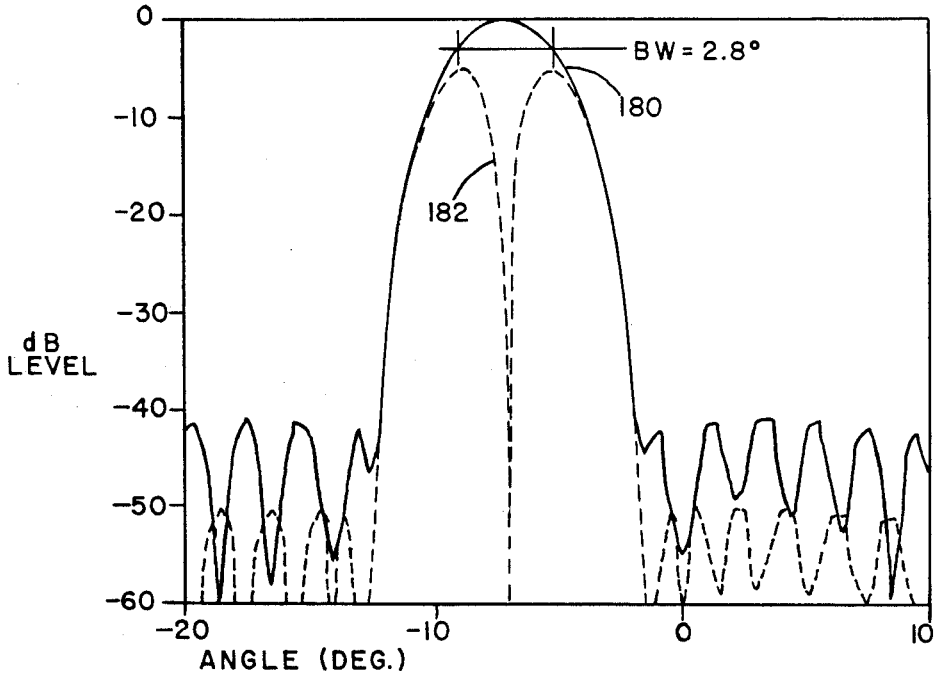
FIG. 9 is a graph illustrating relative power versus azimuth angle in an antenna system of the present invention.
Figure 10:
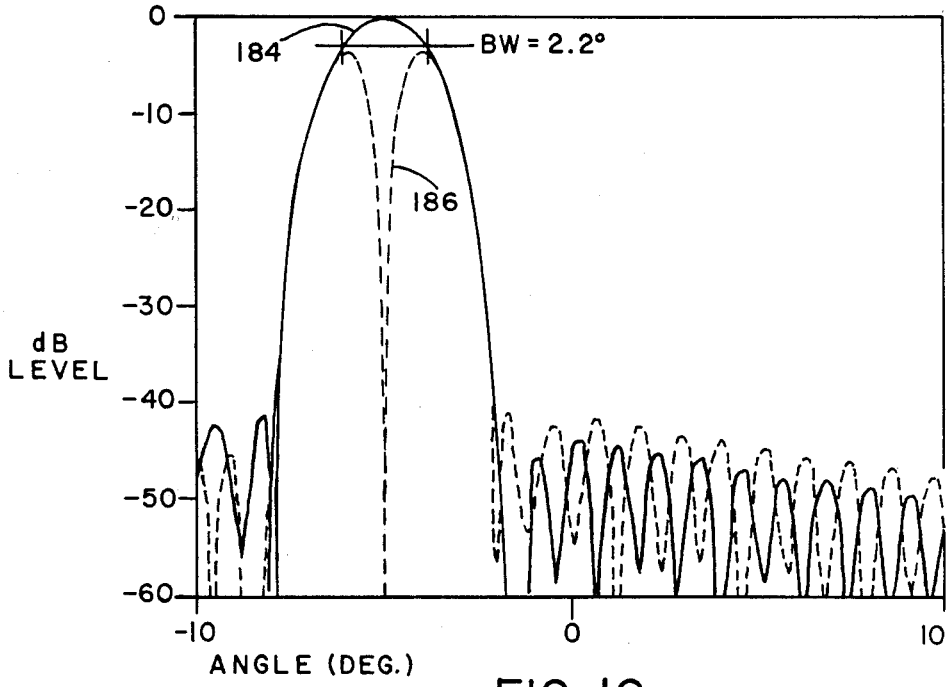
FIG. 10 is a graph illustrating relative power versus elevation angle in an antenna system of the present invention.

FIGS. 9 and 10 illustrate the theoretical respective azimuth and elevation radiation patterns for the full-up antenna. The solid lines in FIGS. 9 and 10, respectively curves 180 and 184, illustrate azimuth and elevation angles versus relative power in the sum patterns. The dashed lines, respectively curves 182 and 186, illustrate azimuth and elevation angles versus relative power in the difference patterns.

Figure 8:
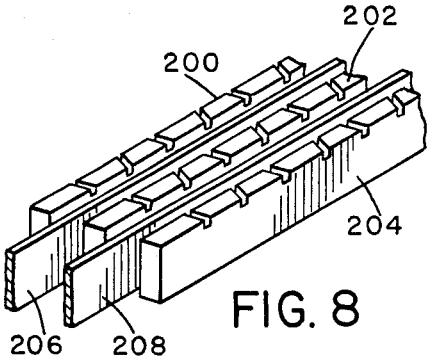
FIG. 8 is a perspective view of an antenna taken in section with the antenna having isolation fences between radiating sections.

Due to the closeness of the adjacent radiating waveguides, mutual coupling is experienced between adjacent radiating waveguide slot elements. To reduce mutually coupling, isolation fences may be installed between adjacent radiating waveguides without significant sidelobe degradation. FIG. 8 illustrates radiating waveguides 200, 202 and 204 positioned in a spaced-apart parallel relationship. Disposed between radiating waveguide 200 and radiating waveguide 202, and spaced apart from each, is isolation fence 206. Similarly illustrated is isolation fence 208 which is disposed between adjacent radiating sections 202 and 204. Isolation fences constructed for the structure disclosed herein are formed of 0.032 inch thick aluminum. Since maximum coupling occurs between those portions of the slot elements that extend into the sidewalls of the radiating waveguide, optimum fence height is the height of the waveguide. If the fence is made higher, it causes propagated energy to operate in an area below cutoff such that electromagnetic radiation is significantly attenuated.

Although the isolation fences are effective in reducing coupling between radiating waveguides slot elements, such fences tend to affect relative slot conductances. As a result, the amplitude distribution of the slotted array is affected. The net effect of this change in amplitude to distribution appears in the overall pattern as increased sidelobes. However, sidelobe degradation caused by the isolation fences is not a significant factor.

For purposes of demonstrating that the antenna of the present invention has a sufficiently deep null over a 7% frequency band, an analysis of how the radiation patterns are derived follows. With reference to FIG. 1, the radiation at the output of each array of the two antenna arrays, as a function of the look angle $\theta$ is given by the following equations:

$$E_1(\theta) = \sum_{n=1}^{N_1} I_{n1} \exp[j(nkd_{x1}\sin\theta/\lambda) + j\psi n_1] \tag{5}$$

$$E_2(\theta) = \sum_{n=1}^{N_2} I_{n2} \exp[j(nkd_{x2}\sin\theta/\lambda) + j\psi n_2 - j\theta] \tag{6}$$

where:

$k=2\pi/\lambda$ $d_{x1}$ and $d_{x2}$ are the spacing parameters between the slot elements of the respective arrays;

$I_{n1}$ and $I_{n2}$ are the incremental amplitudes of each slot element;

$N_1$ and $N_2$ are the number of radiating waveguides in each of the radiating waveguide arrays;

$\Psi n_1$ and $\Psi n_2$ are the incremental phases at each slot element; and $\lambda$ is the wavelength of the operating frequency.

Expressions (5) and (6) can also be expressed in the form:

$$E_1(\theta) = \sum_{n=1}^{N_1} I_{n1} \exp(jkd_{x1}\sin\theta) \cdot \exp(j\psi n_1) \tag{7}$$

$$E_2(\theta) = \sum_{n=1}^{N_2} I_{n2} \exp(jkd_{x2}\sin\theta) \cdot \exp(j\psi n_2) \tag{8}$$

To achieve a deep null:

$$E_1(\theta) - E_2(\theta) = 0, \text{ or } E_1(\theta)/E_2(\theta) = j0^\circ \tag{9}$$

Therefore, if $N_1 = N_2 = N$ then:

$$\frac{E_1(\theta)}{E_2(\theta)} = \sum_{n=1}^{N} \frac{I_{n1}}{I_{n2}} \exp[jk\mathrm{Sin}\theta(d_{x1} - d_{x2})] \cdot \exp[j(\Psi_{n1} - \Psi_{n2})]\exp[j\theta] \tag{10}$$

since:

$I_{n1}=kI_{n2}$;

$d_{x1}=d_{x2}=d_x$;

$\Psi n_1=2\pi d\ n\ \sin(\theta_{TL})$;

$\Psi n_2=2\pi d\ n\ \sin(\theta_{TR})$;

where $\theta_{TL}$ and $\theta_{TR}$ are the respective beam-tilt positions of the radiating waveguide arrays.

Expression (10) will therefore be reduced to:

$$\frac{E_1(\theta)}{E_2(\theta)} = k \sum_{n=1}^{N} \exp[jkd_x(\sin\theta_{TL} - \sin\theta_{TR})] \tag{11}$$

for:

$$\frac{E_1(\theta_o)}{E_2(\theta_o)} = 1\ \mathrm{Exp}(j0^\circ) \tag{12}$$

where:

$\theta_o$ is the angle where the two beams have equal amplitude.

Then $\theta_o$ must be:

$$\theta_o = kd_x(\sin\theta_{TLo} - \sin\theta_{TRo}) \tag{13}$$

where: $\theta TL_o$ and $\theta TR_o$ are the respective beam tilts at the center frequency of the antenna; and $$K=2\pi/\lambda o. \tag{14}$$

Combining equations (11)–(14), we have $$Arg\left[\frac{E_1(\theta_o)}{E_2(\theta_o)}\right] = kd_x[(\sin\theta_{TL} - \sin\theta_{TR}) - (\sin\theta_{TLo} - \sin\theta_{TRo})] \quad (15)$$

Assuming the tilt angles are near boresight:

$$Arg\left[\frac{E_1(\theta_o)}{E_2(\theta_o)}\right] = kd_x\,[(\theta_{TL} - \theta_{TR}) - (\theta_{TLo} - \theta_{TRo})] \quad (16)$$

and combining terms;

$$Arg\left[\frac{E_1(\theta_o)}{E_2(\theta_o)}\right] = kd_x\,[\Delta T_L - \Delta T_R] \quad (17)$$

where:

$\Delta T_L = \Delta T_R$ = tilt from center frequency beam tilt and $\Delta T_L = \theta T_L - \theta TLo$; and $\Delta T_R = \theta TR - \theta TRo$. From this, it can be concluded that to achieve optimum null depth over the operating frequency band:

$$\Delta T_L - \Delta T_R = 0 \quad (18)$$

Equation (17) shows that the left and right beams must closely track each other in order to achieve a sufficient null depth over the frequency band. This leads to the expression:

$$Nkd_x\,(\sin\theta_{TL} - \sin\theta_{TR}) = 360° \quad (19)$$

From equation (19), with waveguide arrays of an equal number of radiating waveguides, the number of radiating waveguides can be calculated from:

$$N = \frac{n\lambda o}{d_x(\sin\theta_{TL} - \sin\theta_{TR}} \quad n = 1,2,3,\ldots\ d_x(\sin\theta_{TL} - \sin\theta_{TR}$$

Figure 11:
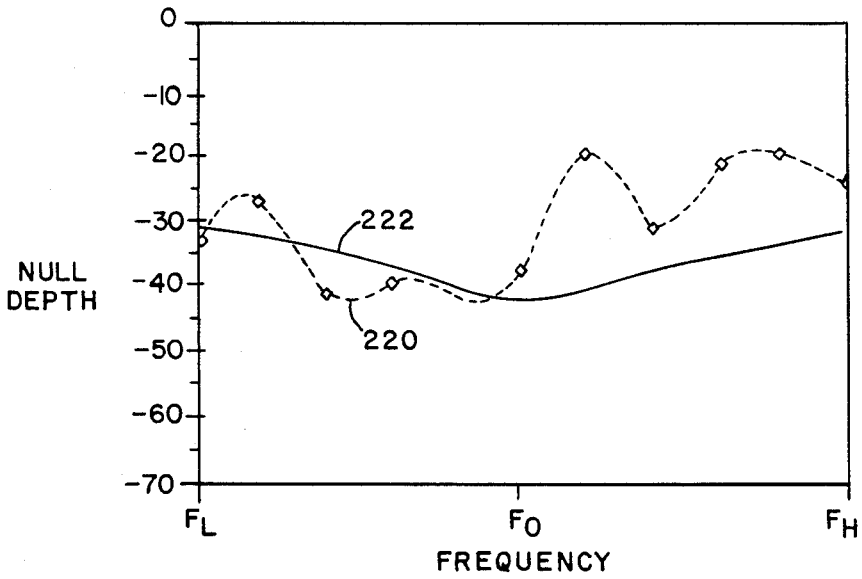
FIG. 11 is a graph of null depth versus frequency.

The previous analysis is used for determining the theoretical null depth versus frequency for two designed configurations. FIG. 11 illustrates the measured, curve 220, and theoretical, curve 222, null depth of a two-element monopulse array with 89 and 92 slot elements in each radiating waveguide of 89 and 92. With reference to FIG. 11, it was determined that because of the perturbations in the measured null depth vs. frequency, the ground reflections play a significant role in degrading measured performance. However, a null depth analysis shows that improved performance is achievable with equal slot spacings for alternate arrays. To confirm the null depth analysis, sixteen arrays were fabricated with sixty elements each. Two different waveguide "a" dimensions were used as the means for providing the two beam positions for these amplitude monopulse radiation patterns. The design criteria used for providing the beam tilts utilizing different "a" dimensions and different slot spacing for the alternate waveguide radiators are shown in Table 1.

TABLE 1

| | Alternate Waveguide Radiators Utilizing Different "a" Dimensions | |
|---|---|---|
| | Odd Radiators | Even Radiators |
| Waveguide "a" dim. (λo) | 0.732 | 0.646 |
| Element Spacing (λo) | 0.693 | 0.693 |
| No. of Elements | 62 | 62 |
| Beam Tilt $f_L$ | 2.2° | 4.4° |
| $f_O$ | 4.5° | 7.0° |
| $f_H$ | 7.8° | 9.6° |

TABLE 1-continued

| | Alternate Waveguide Radiators Utilizing Different Slot Element Spacing | |
|---|---|---|
| | Odd Radiators | Even Radiators |
| Waveguide "a" dim. (λo) | 0.732 | 0.732 |
| Element Spacing (λo) | 0.689 | 0.662 |
| No. of Elements | 89 | 92 |
| Beam Tilt $f_L$ | −4° | −6° |
| $f_O$ | −7° | −9° |
| $f_H$ | −10.2° | −12.4° |

Note: (λo) = wavelength at center frequency ($f_o$)

In the design utilizing equal element spacings between alternate waveguide radiators of the array, there are several parameter trade-offs that must be understood in order to achieve optimum performance. From expression (1) determining beam tilt:

$$\theta = \sin^{-1}(\lambda/\lambda g - \lambda/2d) \quad (20)$$

where:

λ is the wavelength of operating frequency;

λg is the wavelength in the waveguide, $$\frac{\lambda}{\sqrt{1 - (\lambda/2a)^2}}$$

d is the element spacing; and a is the waveguide "a" dimension.

Figure 12:
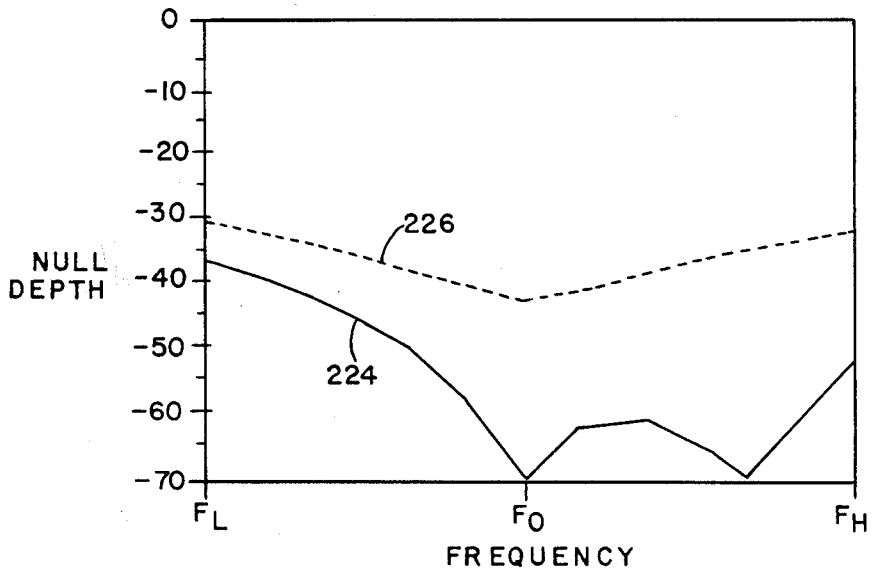
FIG. 12 is a graph of null depth versus frequency.

The theoretical null depth between the two designs summarized in Table 1 is illustrated in FIG. 12. In FIG. 12, curve 224 represents the null depth over frequency for a design with alternate waveguide radiators utilizing different "a" dimensions. Similarly, curve 226 represents the null depth over frequency for a design with alternate waveguide radiators utilizing different slot spacings.

The null depth versus frequency at the antenna's azimuth and elevation difference ports tend to be the most significant performance-limiting parameter. If not considered in the design of the antenna, there is a tendency of null filling as frequency is varied. Analytically to obtain deep null depths over a wide frequency band, several criteria must be met. The first criteria is that the resultant differential phase between the first and last radiating slots of adjacent radiating waveguides should be an integral multiple of 360°. This differential phase may be accomplished by varying the guide wavelengths instead of slot spacing between alternate radiating waveguides. The second criterion is that the phase adjusting waveguide should be inserted into the radiating waveguides having the smallest guide wavelengths. Following the above criteria will give the antenna a compensating effect over a broad frequency range. Furthermore, difference port null depths may be optimized further by manipulation of the guide wavelength of the phase adjustor.

The beamwidth of the individual beams is basically determined by the size of the antenna aperture. However, the sum port beamwidth of an amplitude comparison monopulse antenna is also affected by the separation of the beam-tilt angles. The aperture size can be made as large as physically realizable to reduce beamwidth. As the tilt angle between beams becomes smaller, the sum-to-difference ratio will suffer and result in the amplitude of the difference peak being unacceptably much smaller than that of the sum peak. However, if the tilt angle between beams becomes too large, a widening in the beamwidth of the sum peak occurs which results in lowered gain.

Figure 13:
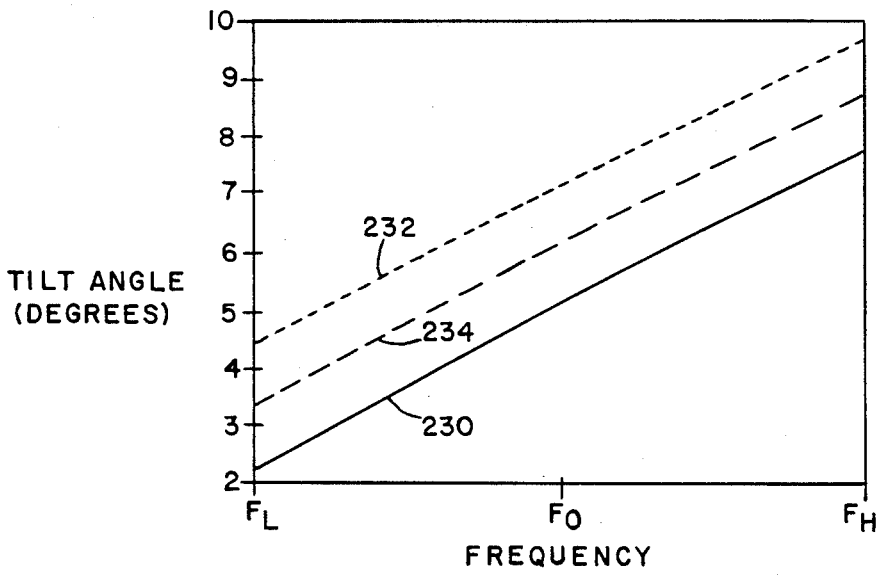
FIG. 13 is a graph illustrating elevation-plane beam position between alternate waveguide radiating sections versus frequency.
Figure 14:
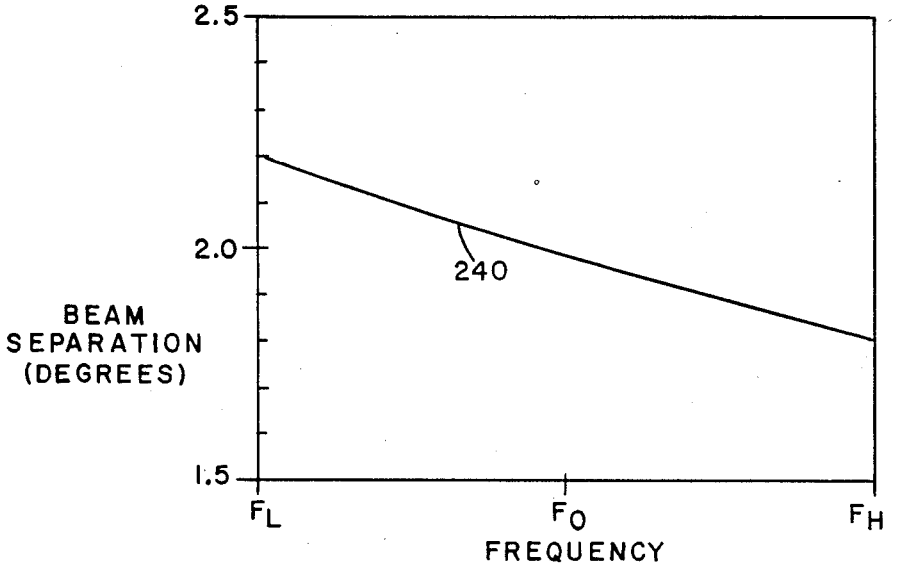
FIG. 14 is a graph illustrating beam separation between alternate waveguide radiating sections versus frequency.

In an antenna with different "a" dimensions for alternate waveguides, the beam tilt versus frequency will be variant. Beam tilt for this antenna arrangement is set forth in Table 1 and graphically illustrated in FIG. 13. FIG. 13 shows that the beam position for alternate waveguide varies between 2.2° and 7.8° for the left beam, curve 230, and between 4.4° and 9.6° for the right beam, curve 232. The null varies between 3.3° and 8.3° and is illustrated in FIG. 13 as curve 234. In FIG. 14, curve 140 presents the variation in beam separation between the alternative radiating waveguide sections versus frequency for an array using different "a" dimensions for alternate waveguides. The tilt angle and beam separation parameters are the key to the trade-offs between beamwidth and sum-to-difference ratio.

From the teachings of the present invention, it is readily apparent that many different low-sidelobe amplitude comparison monopulse antennas utilizing traveling wave techniques may be constructed. The previous description of the preferred embodiments are therefore provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiment shown herein, but is to be accorded the widest scope consistent with the principles and novel features disclosed herein.

What is claimed is:

1. A traveling wave antenna having a far field antenna of pattern substantially four separate beams, comprising:

a first array of radiating waveguides, each of said first array radiating waveguides having a near end and a far end, with radiating slots formed therebetween;

a second array of radiating waveguides, each of said second array radiating waveguides having a near end and a far end with radiating slots formed therebetween, said first and second array radiating slots interleaved in a planar spaced parallel relationship, the near end of said first array and the near end of said second array lying substantially in a common plane orthogonal to a plane defined by said first and second arrays;

first and second pairs of feed waveguides corresponding to said first and second arrays of radiating waveguides, each of said feed waveguides having an input end and a load end, and coupled therebetween to the near end of each of said corresponding array of radiating waveguides, each radiating waveguide coupled to a certain one of said feed waveguides being identically coupled to said certain feed waveguide, wherein the energy coupled through each one of said feed waveguides is generally associated with a different one of said separate beans.

2. The antenna of claim 1 further comprising:

a first plurality of pieces of RF absorbing material each mounted at the far end of each radiating waveguide; and a second plurality of pieces of RF absorbing material each mounted at the load end of each feed waveguide.

3. The antenna of claim 1 further comprising a monopulse comparator to the input ends of said first and said second pairs of feed waveguides.

4. The antenna of claim 3 wherein said monopulse comparator comprises first, second, third, and fourth hybrid tees, each of said hybrid tees having a pair of symmetry arms, a sum arm and a difference arm, said first hybrid tee symmetry arms each respectively coupled to the input end of said first pair of feed waveguides, said second hybrid tee symmetry arms each selectively coupled to the input end of said second pair of feed waveguides, wherein the energy coupled through each one of said symmetry arms of said first and second hybrid tees is generally associated with a different one of said separate beams, said third hybrid tee symmetry arms respectively coupled to said first and second hybrid tees difference arms, and said fourth hybrid tee symmetry arms respectively coupled to said first and second hybrid tees sum arms.

5. The antenna of claim 1 wherein said radiating slots are formed in a linear portion along the longitudinal axis of each of said radiating waveguides with said linear portions defining a planar array.

6. The antenna of claim 5 further comprising a monopulse comparator having first, second, third and fourth hybrid tees, each of said hybrid tees having a pair of symmetry arms, a sum arm and a difference arm, said first hybrid tee symmetry arms each respectively coupled to the input end of said first pair of feed waveguides, said second hybrid tee symmetry arms each respectively coupled to the input end of said second pair of feed waveguides, wherein the energy coupled through each one of said symmetry arms of said first and second hybrid tees is generally associated with a different one of said separate beams, said third hybrid tee symmetry arms respectively coupled to said first and second hybrid tees difference arms, and said fourth hybrid tee symmetry arms respectively coupled to said first and second hybrid tees sum arms.

7. A tracking system antenna having a far field antenna pattern substantially comprising four separate beams comprising:

a first array of radiating members, each of said first array radiating members having a near end, a far end and a linear portion with radiating slots formed therein;

a second array of radiating members, each of said second array radiating members having a near end, a far end and a linear portion with radiating slots formed therein, said linear portions of said first and said second array radiating members interleaves in a planar spaced parallel relationship, the near end of said first array and the near end of said second array lying substantially in a common plane orthogonal to a plane defined by said first and second arrays;

two sets of bifurcated members, each member having a unitary portion and a bifurcated portion with a pair of coupling ends, each of said first set of bifurcated members being coupled at a corresponding unitary portion to the near end of a different radiating member of said first array and each of said second set of bifurcated members being coupled at a corresponding unitary portion to the near end of a different radiating member of said second array; and first and second pairs of feed members, each feed member of said first pair of feed members being respectively coupled to a different coupling end of each of said first set of said bifurcated members and each feed member of said second pair of feed members being respectively coupled to a different coupling end of each of said second set of said bifurcated members each bifurcated member coupled to a certain one of said feed members being identically coupled to said certain feed member, wherein the energy coupled through each one of said feed members is generally associated a different one of said separate beams.

8. The antenna of claim 7 further comprising:

a first plurality of edges of RF absorbing material each mounted at the far end of each radiating member; and a second plurality of wedges of RF absorbing material each mounted at the load end of each feed member.

9. The antenna of claim 7 further comprising a monopulse comparator having first, second, third and fourth hybrid tees, each of said hybrid tees having a pair of symmetry arm members, a sum arm member and a difference arm member, said first hybrid tee symmetry arm members each respectively coupled to one end of a different feed member of said first pair of feed members with said second hybrid tee symmetry arm members each respectively coupled to one end of a different feed member of said second pair of feed members wherein the energy coupled through each one of said symmetry arms of said first and second hybrid tees is generally associated with a different one of said beams, said third hybrid tee symmetry arm members respectively coupled to said first and second hybrid tees difference arm members, said fourth hybrid tee symmetry arm members respectively coupled to said first and second hybrid tees sum arm members.

10. A tracking system antenna having a far field antenna pattern of substantially four separate beams, comprising:

a first array of rectangular radiating waveguides, each of said first array radiating waveguides having a near end, a far end and a linear portion with edge radiating slots formed therebetween;

a second array of rectangular radiating waveguides, each of said second array radiating waveguides having a near end, a far end and linear portion with radiating slots formed therebetween, said linear portions of said first and said second array radiating waveguides interleaved in a planar spaced parallel relationship, the near end of said first array and the near end of said second array lying substantially in a common plane orthogonal to a plane defined by said first and second arrays;

two sets of rectangular bifurcated waveguides, each of said bifurcated waveguides having a unitary portion and a bifurcated portion with a pair of coupling ends, each of said first set of said bifurcated waveguides being coupled at a corresponding unitary portion to the near end of a different radiating waveguide of said first array and each of said second set of said bifurcated waveguides being coupled at a corresponding unitary portion to the near end of a different radiating waveguide of said second array; and first and second pairs of rectangular feed waveguides, each feed waveguide of said first pair of feed waveguides being respectively coupled to a different coupling end of each one of said first set of said bifurcated waveguides, and each feed waveguide of said second pair of feed waveguides being coupled to a different coupling end of each one of said second set of said bifurcated waveguides, each bifurcated waveguide coupled to a certain one of said feed waveguides being identically coupled to said certain feed waveguide, wherein the energy coupled through each one of said feed waveguides is generally associated a different one of said separate beams.

11. The antenna of claim 10 further comprising:

a first plurality of edges of RF absorbing material each mounted at the far end of each radiating member; and a second plurality of edges of RF absorbing material each mounted at the load end of each feed member.

12. The antenna of claim 10 further comprising a monopulse comparator having first, second, third and fourth hybrid tees, each of said hybrid tees having a pair of waveguide symmetry arms, a waveguide sum arm and a waveguide difference arm, said first hybrid tee symmetry arms each respectively coupled to the input end of said first pair of rectangular feed waveguides, said second hybrid tee symmetry arms each respectively coupled to the input end of said second pair of rectangular feed waveguides, wherein the energy coupled through each one of said symmetry arms of said first and second hybrid tees is generally associated with a different one of said separate beams, said third hybrid tee symmetry arms respectively coupled to said first and second hybrid tees difference arms, and said fourth hybrid tee symmetry arms respectively coupled to said first and second hybrid tees sum arms.

* * * * *

UNITED STATES PATENT AND TRADEMARK OFFICE

CERTIFICATE OF CORRECTION

PATENT NO. : 4,958,166

DATED : September 18, 1990

INVENTOR(S) : Branigan, et al.

It is certified that error appears in the above-identified patent and that said Letters Patent is hereby corrected as shown below:

Column 14, claim 3, line 5, after "comparator" insert --coupled--;

Column 16, claim 11, line 31, "edges" should be --wedges--;

Column 16, claim 11, line 34, "edges" should be --wedges--

Signed and Sealed this

Twenty-sixth Day of May, 1992

*Attest:*

DOUGLAS B. COMER

*Attesting Officer*

*Acting Commissioner of Patents and Trademarks*